US007303655B2

(12) United States Patent
Jewitt

(10) Patent No.: US 7,303,655 B2
(45) Date of Patent: Dec. 4, 2007

(54) APPARATUS FOR CONDITIONING A FABRIC IN A PAPERMAKING MACHINE AND ASSOCIATED METHOD

(75) Inventor: Dennis Edward Jewitt, St. Marys Platt (GB)

(73) Assignee: Metso Paper Karlstad Aktiebolag (AB), Karlstad (SE)

( * ) Notice: Subject to any disclaimer, the term of this patent is extended or adjusted under 35 U.S.C. 154(b) by 462 days.

(21) Appl. No.: 10/936,838

(22) Filed: Sep. 9, 2004

(65) Prior Publication Data

US 2005/0204580 A1 Sep. 22, 2005

Related U.S. Application Data

(60) Provisional application No. 60/554,810, filed on Mar. 19, 2004.

(51) Int. Cl.
*D21F 1/32* (2006.01)
*D21F 5/00* (2006.01)

(52) U.S. Cl. ..... 162/199; 162/272; 162/274; 162/275; 162/279; 34/444; 34/623

(58) Field of Classification Search ..... 162/199, 162/272, 274–279, 207, DIG. 7; 15/309.1; 34/313, 316, 444, 453, 459, 618, 623
See application file for complete search history.

(56) References Cited

U.S. PATENT DOCUMENTS

| | | | | |
|---|---|---|---|---|
| 1,610,545 | A * | 12/1926 | Asten | 162/274 |
| 3,298,904 | A * | 1/1967 | Compte, Jr. | 162/274 |
| 3,347,740 | A * | 10/1967 | Goumeniouk | 162/199 |
| 3,432,936 | A | 3/1969 | Cole et al. | |
| 5,381,580 | A * | 1/1995 | Kotitschke et al. | 15/302 |
| 6,153,056 | A | 11/2000 | Schiel | |
| 6,199,296 | B1 | 3/2001 | Jewitt | |
| 6,398,916 | B1 | 6/2002 | Klerelid | |
| 6,451,171 | B1 | 9/2002 | Jewitt | |
| 6,581,301 | B1 | 6/2003 | Thorp | |

FOREIGN PATENT DOCUMENTS

DE 102 41 181 A1 3/2004

* cited by examiner

*Primary Examiner*—Eric Hug
(74) *Attorney, Agent, or Firm*—Alston & Bird LLP

(57) ABSTRACT

An apparatus is provided for conditioning a fabric being advanced in a machine direction in a papermaking machine. The fabric has an outer side adapted to engage a paper web and an opposing inner side. Such an apparatus comprises a fluid-emitting device configured to wet the fabric with a fluid so as to clean the fabric. An arcuate member disposed downstream of the fluid-emitting device is configured to engage the outer side of the fabric. More particularly, the arcuate member is configured to have the fabric wrapped at least partially thereabout such that the advancing fabric is centrifugally dewatered. Associated systems and methods are also provided.

21 Claims, 5 Drawing Sheets

APPARATUS FOR CONDITIONING A FABRIC IN A PAPERMAKING MACHINE AND ASSOCIATED METHOD

CROSS-REFERENCE TO RELATED APPLICATIONS

This application claims the benefit of U.S. Provisional Application No. 60/554,810, filed Mar. 19, 2004.

BACKGROUND OF THE INVENTION

1. Field of the Invention

The present invention relates to papermaking machines and, more specifically, to an apparatus for conditioning a fabric and associated system and method.

2. Description of Related Art

A through-air drying (TAD) fabric is typically an open-weave fabric configured to receive a relatively wet paper web and to transport the web to one or more drying devices, such as a through-air dryer, for the drying device to interact with the fabric and the web to form a relatively dry paper web. The web is then separated from the fabric downstream of the drying device and advanced to subsequent processes. However, the paper web may undesirably leave residue on the fabric after being separated therefrom. Since the fabric is typically configured as a loop, the residue must be removed from the fabric, before the fabric advances back to the point at which the web is received by the fabric, in order to, for example, avoid contamination of the paper web. In addition, the residue on the fabric may also reduce the permeability thereof and may adversely affect drying performance, resulting in "wet spots" in the web as the web exits the drying device(s). In light of this requirement, the fabric is usually cleaned with water and then dewatered, in a collective process known as conditioning, when the fabric is not carrying the web.

In one known conditioning method, characterized as a horizontal conditioning configuration as shown in FIG. 1, the fabric 5 enters the conditioning section 10 and wraps about an inlet roll 15. The fabric 5 includes an outer or sheet side 5A for carrying the web, and an opposing inner side 5B. At the upstream side of the inlet roll 15, the fabric 5 is subjected to cleaning fluid, such as water, from a flooded nip shower 20. As the fabric 5 further advances about the inlet roll 15, the fabric 5 may also be subjected to cleaning fluid from one or more fan or needle showers 25, 30, 35 that may direct the cleaning fluid at the fabric 5 at different angles and toward one or both sides of the fabric 5. A variety of shower types and shower positions may be implemented depending on process requirements. A vacuum box 40 is disposed downstream of the showers for removing excess cleaning fluid from the fabric 5, in a process referred to as dewatering. In some instances, other devices, such as an air knife or another vacuum device, may be used in the alternative or in addition to the vacuum box 40 for dewatering the fabric 5. As such, according to this method, the fabric 5 is directed to run in a generally horizontal orientation to the inlet roll 15 and, after advancing over the inlet roll 15, in the opposite direction in a generally horizontal orientation to pass the showers and the vacuum box 40. Thereafter, the fabric 5 is advanced about an exit roll 45 so as to direct the fabric 5 back toward the point at which the web is received and, as a result, is generally directed under the showers dispensing the cleaning fluid and the drainage system for collecting the excess cleaning fluid as well as the cleaning fluid dewatered from the fabric 5.

In another known conditioning method, characterized as a vertical conditioning configuration as shown in FIG. 2, the fabric 5 is advanced over the inlet roll 15 and then advanced downward in a generally vertical direction. A flooded nip shower 20 is directed at the fabric 5 and disposed at the upstream side of the inlet roll 15. On the downward run, the fabric 5 is subjected to one or more showers, wherein, as before, various shower types and shower positions may be implemented depending on process requirements. Following the showers, the fabric 5 is subject to one or more dewatering devices, such as a vacuum box 40 or air knife. The fabric 5 is then directed about an exit roll 45 and otherwise redirected back to the point at which the web is received.

The known conditioning methods, however, may have characteristics that can have an adverse effect on the papermaking process. For example, the water or cleaning fluid emitted by the showers in spray or solid stream form tends to bypass the vacuum box or other dewatering device and undesirably rewet the fabric before exiting the conditioning section. In order to address this rewetting problem, elaborate and often expensive sealing methods may be employed. However, these sealing methods are often ineffective and may require extensive maintenance. Further, since no removal of the cleaning fluid from the fabric, other than by limited drainage due to gravity, is performed before fabric is subjected to dewatering by the vacuum box or other dewatering device, the fabric typically arrives at the vacuum box in a very wet condition. As such, in order for the vacuum box to effectively remove the sufficient and/or desired amount of water from the fabric, the vacuum box must generally be operated at a high level, which may cause an undesirably high level of power consumption.

In some instances, where the fabric comprises a through-air drying (TAD) fabric, the outer side of the TAD fabric may be sanded or otherwise processed (such as by hot calendering) in order to achieve a desired contact area between the web formed thereon and downstream processes. Sanding of the TAD fabric provides for particular contact characteristics between the fabric and the web, as well as between the web and downstream processes. For example, the fabric may be sanded to achieve about a 20% contact area between the web and the cylinder of a Yankee dryer, as the web is transferred thereto from the drying fabric. As such, the condition of the sanded surface of the fabric may affect some parameters, such as the style or weave pattern imparted to the web, the coarseness of the web, or the contact area between the web and the cylinder of a Yankee dryer, and thereby affect the properties of the web. In such instances of a sanded fabric surface, contact between the sanded outer side of the advancing fabric and certain stationary elements may cause wear to the sanded outer side and, as a result, may adversely increase the contact area of the fabric and thereby detrimentally affect the applicable process parameters. In this regard, the known conditioning methods illustrated in FIGS. 1 and 2 both indicate that the vacuum box used for dewatering the fabric is configured to interact with the sheet or outer side of the fabric that may be sanded.

In the event of operational problems within the drying section, including a Yankee dryer, if provided, there may be instances in which the web may not be removed or separated from the fabric prior to the fabric entering the conditioning section. As a result, a full width sheet of the web may sometimes inadvertently enter the conditioning section. Where the dryer comprises a through-air dryer (TAD), the drying conditions of the TAD tend to cure a high wet strength resin to a greater extent than other drying methods and, as such, a high wet strength resin may be difficult to dissolve under the conditions present in the conditioning section. In addition, some of the liquid extracted from the web/fabric by the molding box and/or transfer device may also tend to include such a high wet strength resin, which may further tend to remain with or adhere to the fabric during the drying process. Accordingly, a conditioning section should desirably be configured to allow ready access for removing any portions of the paper web, or associated fines or chemicals, that are not removed from the fabric in normal operating conditions. The conditioning section should also be configured to facilitate periodic maintenance, as well as fabric changing procedures.

Thus, with respect to a conditioning section in a drying section of a papermaking machine, there exists a need for a fabric-conditioning apparatus and method that reduces or eliminates rewetting of the fabric exiting the conditioning process. Such a solution should desirably be accomplished without requiring elaborate and expensive sealing provisions. The conditioning apparatus and method should also desirably reduce or eliminate contact between outer side of the fabric and stationary elements. There also exists a need for an effective dewatering process with reduced energy consumption.

BRIEF SUMMARY OF THE INVENTION

The above and other needs are met by the present invention which, in one embodiment, provides an apparatus for conditioning a fabric being advanced in a machine direction in a papermaking machine, wherein the fabric has an outer side adapted to engage a paper web and an opposing inner side. Such an apparatus comprises a fluid-emitting device configured to wet the fabric with a fluid so as to clean the fabric. An arcuate member disposed downstream of the fluid-emitting device is configured to engage the outer side of the fabric. The arcuate member is further configured to have the fabric wrapped at least partially thereabout such that the advancing fabric is centrifugally dewatered.

Another advantageous aspect of the present invention comprises a drying section for a papermaking machine. Such a drying section includes a drying device configured to dry a paper web and a fabric configured to be advanced in a machine direction, wherein the fabric has an outer side adapted to engage the web and an opposing inner side. The fabric is further configured to receive the web upstream of the drying device and to transport the web to the drying device so as to allow the drying device to interact with and dry the web. The web then is separated from the fabric downstream of the drying device. An apparatus configured to condition the fabric interacts with the fabric before the web is received by the fabric and after the web is separated from the fabric. Such an apparatus comprises a fluid-emitting device configured to wet the fabric with a fluid so as to clean the fabric. An arcuate member is disposed downstream of the fluid-emitting device and is configured to engage the outer side of the fabric. The arcuate member is further configured to have the fabric wrapped at least partially thereabout such that the advancing fabric is centrifugally dewatered.

Still another advantageous aspect of the present invention comprises a method of conditioning a fabric being advanced in a machine direction in a papermaking machine, wherein the fabric has an outer side adapted to engage the web and an opposing inner side. First, the fabric is wetted with a fluid emitted from a fluid-emitting device so as to clean the fabric. The fabric is then advanced at least partially about an arcuate member, wherein the arcuate member is disposed downstream of the fluid-emitting device and configured to engage the outer side of the fabric, so as to centrifugally dewater the fabric.

As such, embodiments of the present invention provide a conditioning section in which the cleaning and/or showering processes are laterally separated from a final dewatering element, such as a vacuum box, thereby reducing or eliminating the need for sealing of the cleaning elements, rewetting of the fabric exiting the conditioning section, and power consumption by the vacuum box or other final dewatering element. Thus, embodiments of the present invention provide significant advantages as further detailed herein.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

The present inventions now will be described more fully hereinafter with reference to the accompanying drawings, in which some, but not all embodiments of the invention are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

Figure 1:
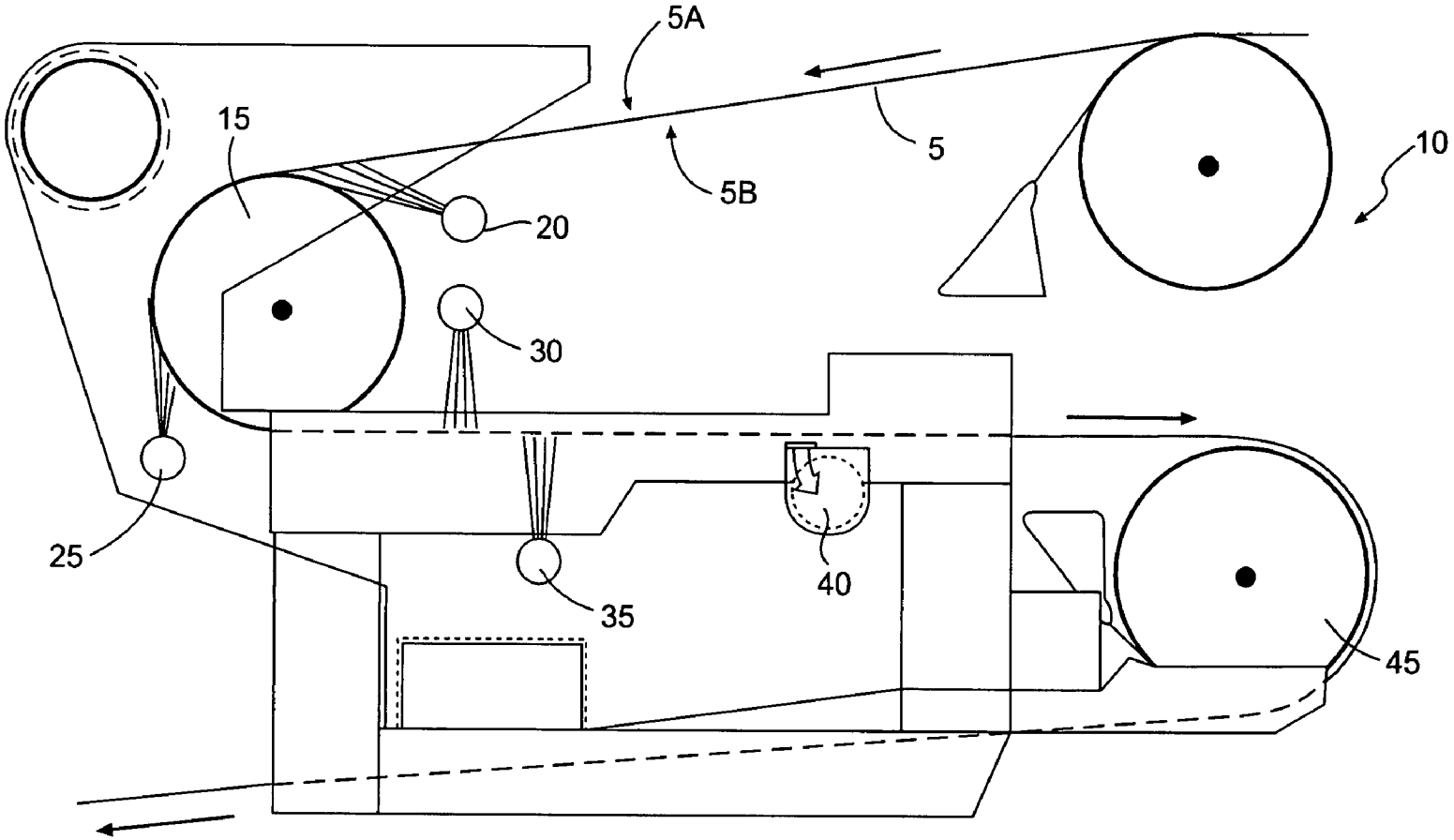
PRIOR ART FIG. 1
FIG. 1 is a schematic illustration of a prior art horizontally-arranged conditioning section for conditioning a fabric in a drying section of a papermaking machine.
Figure 2:
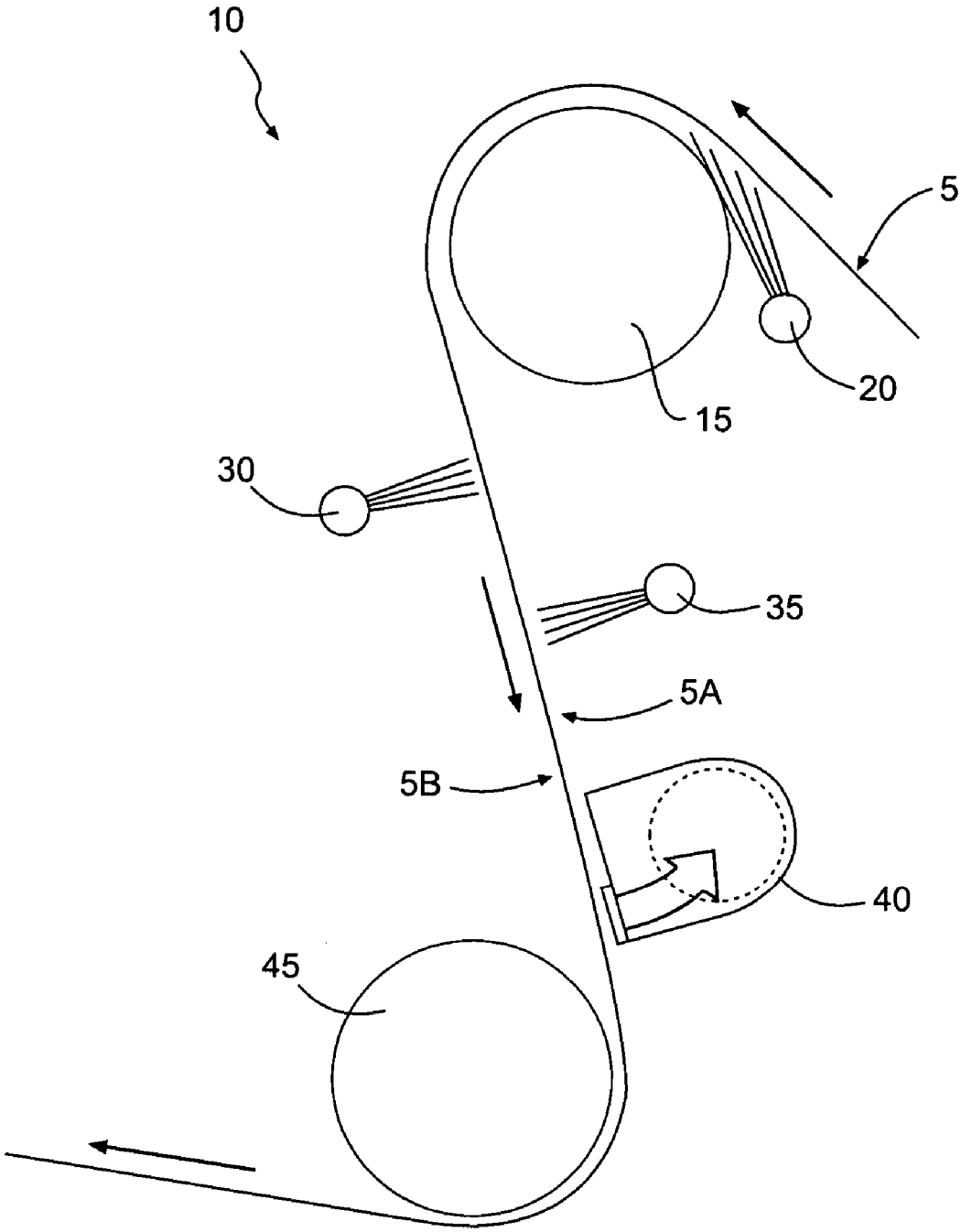
PRIOR ART FIG. 2
FIG. 2 is a schematic illustration of a prior art vertically-arranged conditioning section for conditioning a fabric in a drying section of a papermaking machine.
Figure 3:
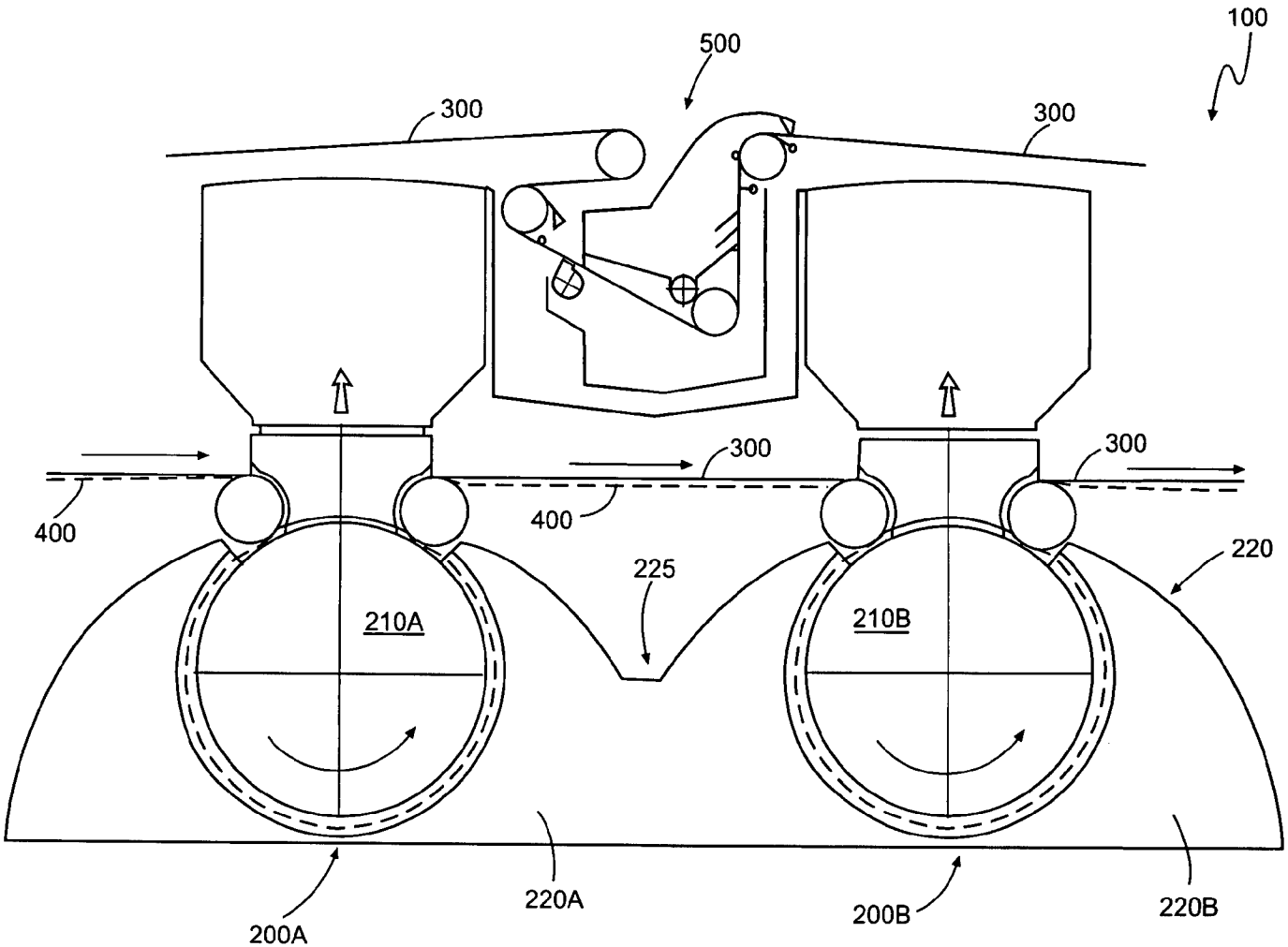
FIG. 3 is a schematic illustration of a drying section of a papermaking machine including a fabric-conditioning section according to one embodiment of the present invention for conditioning a fabric in the drying section.

FIG. 3 illustrates a drying section for a papermaking machine according to one embodiment of the present invention, the drying section being indicated generally by the numeral 100. Such a drying section 100 comprises at least one drying device, though two such drying devices 200A, 200B are illustrated in FIG. 3, and a fabric 300. The fabric 300 is configured to receive a wet paper web 400 and to then transport the web 400 in a machine direction toward the first drying device 200A. Each of the drying devices 200 may be selected from, for example, a through-air dryer, an infrared dryer, an impingement dryer, or the like. Such drying devices 200 are generally configured to interact with the fabric 300 and the web 400 so as to dry the web 400. The fabric 300 may comprise, for example, a through-air drying (TAD) fabric formed from woven filament material so as to provide a relatively rigid open weave or otherwise permeable fabric. Though a TAD fabric is used herein in describing embodiments of the present invention, one skilled in the art will appreciate that the apparatuses, systems, and methods described herein may also be applicable to many other types of fabrics within the scope of the present invention. For example, the fabric 300 may comprise a coarse forming fabric in machine configurations where the forming fabric is also the drying fabric (i.e. the web 400 is formed directly on the drying fabric 300), or the fabric 300 may comprise an embossing or molding fabric in instances where three-dimensional structuring of a newly formed or partially dried web 400, or the fabric 300 may comprise any other relatively thick and open-structured fabric requiring careful cleaning.

In the embodiment illustrated in FIG. 3, each drying device 200A, 200B may comprise, for example, a through-air dryers (TAD) in which a perforated TAD cylinder 210A, 210B is at least partially surrounded by a hood 220A, 220B. Each TAD 200A, 200B may be configured as an inward flow TAD or an outward flow TAD, as will be appreciated by one skilled in the art, though the TADs 200A, 200B are both illustrated herein as inward flow TADs. In such instances, the fabric 300 may comprise a TAD fabric, configured to form a loop about the cylinders 210A, 210B. According to one embodiment of the invention, the respective hoods 220A, 220B may be combined to form a single hood 220 encompassing both cylinders 210A, 210B and defining a gutter 225 therebetween as described, for example, in U.S. Patent Application No. 10/937,029, entitled "Drying Section for a Papermaking Machine and Associated Apparatus and Method," also assigned to Metso Paper Karlstadt AB, the assignee of the present invention, and filed concurrently herewith. The advantages of such a gutter are described in the referenced patent application, which is incorporated herein by reference. The fabric 300 is also configured to receive the wet paper web 400 upstream of the first TAD 200A, for example, from a forming section of the papermaking machine. In some instances, however, the web 400 may be formed directly on the fabric 300. The fabric 300 thereby transports the web 400 to wrap at least partially about each TAD cylinder 210A, 210B, between the respective TAD cylinder 210A, 210B and the corresponding hood 220A, 220B, such that the web 400 is dried to a desired dry solids content upon exiting the second TAD 200B. One skilled in the art will appreciate, however, that the desired dry solids content may be achieved, in some instances, by a single TAD. After exiting the second TAD 200A, the dried web 400 is typically removed or otherwise separated from the fabric 300 for further processing, such as, for example, further drying by a Yankee dryer (not shown), or to be directed to a reel-up (not shown).

One skilled in the art will appreciate that, once the web 400 is separated from the fabric 300, the fabric 300 continues in the loop back to the point at which the web 400 is received. However, the open weave nature of the TAD fabric 300 may cause residue from the web 400 to collect on the fabric 300, thereby possibly shortening the service life of the fabric 300 and/or introducing defects into the web 400 and lowering the quality of the web 400. Accordingly, in one embodiment of the present invention, the drying section 100 further includes a fabric-conditioning apparatus 500 for cleaning, dewatering, and/or otherwise conditioning the fabric 300. A combination of cleaning and dewatering process for the fabric 300 may often be referred to as a conditioning process. The apparatus 500 is disposed about the loop such that the fabric 300 interacts therewith after the web 400 has been separated therefrom, but before the fabric 300 is advanced back to the point at which the web 400 is received. For example, the fabric-conditioning apparatus 500 may be disposed above the gutter 225 defined by the hood 220, as shown in FIG. 3, between the exhaust systems of the respective cross-flow TADS 200A, 200B. Such a configuration may provide, for instance, a more compact drying section 100 and/or a more compact papermaking machine.

Figure 4:
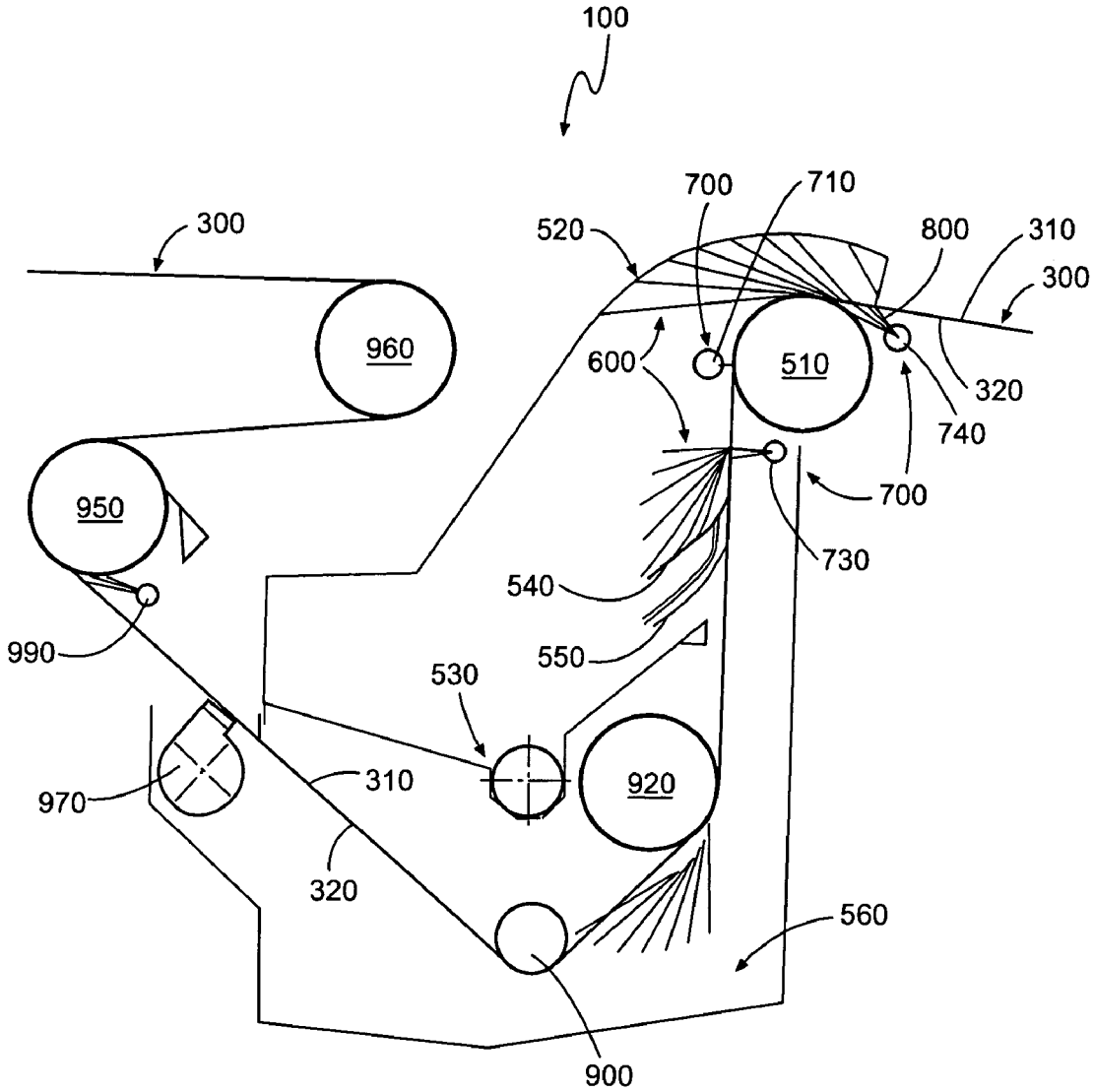
FIG. 4 is a schematic illustration of a fabric-conditioning section according to an alternate embodiment of the present invention.
Figure 5:
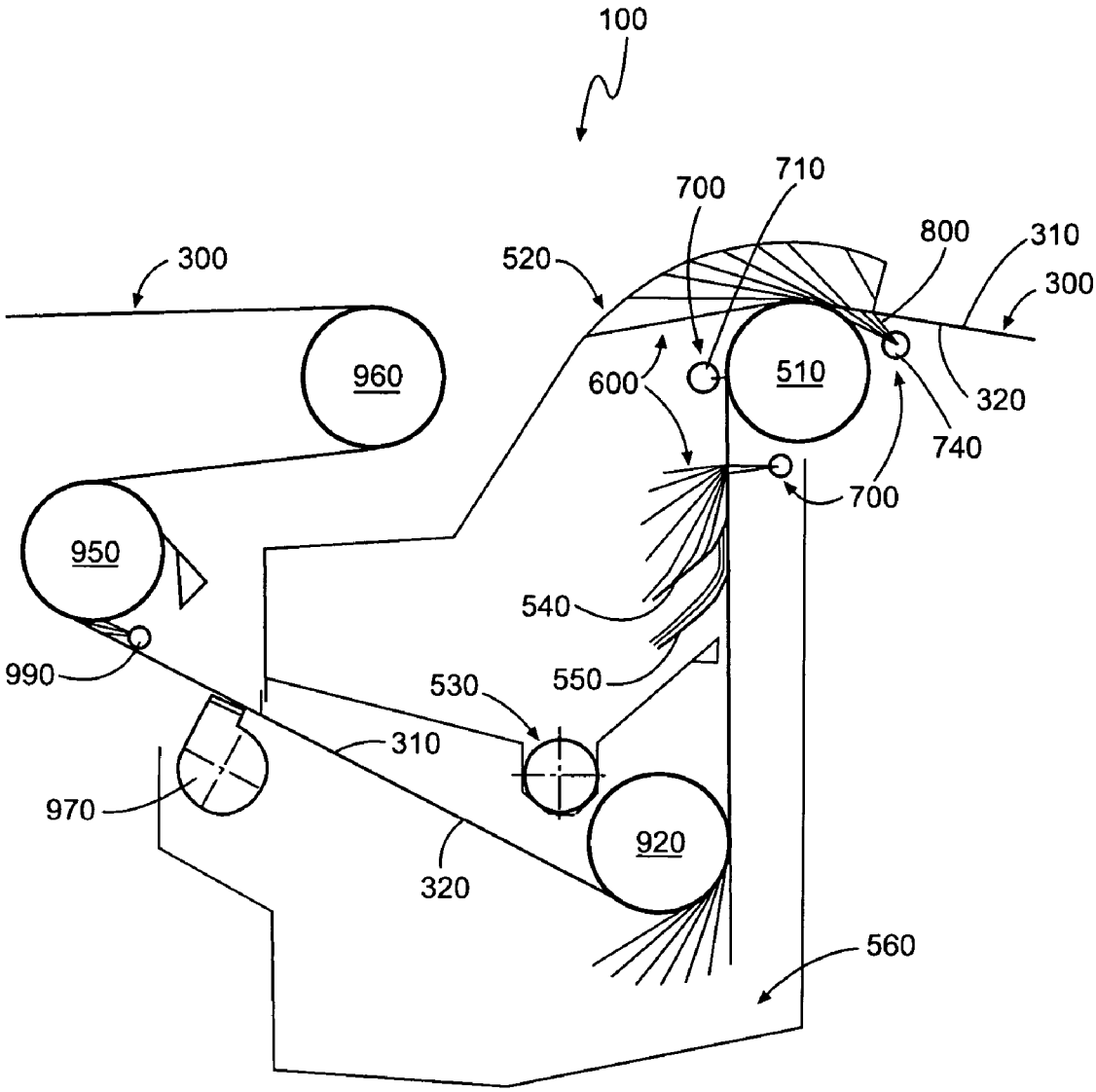
FIG. 5 is a schematic illustration of a fabric-conditioning section according to the embodiment of the present invention shown in FIG. 3.

A TAD fabric 300 may be described in terms of an outer side 310 configured to receive and transport the web 400 and an opposing inner side 320. As shown in FIGS. 3-5, cleaning of the residue from the fabric 300 is a process generally achieved by washing or otherwise wetting the fabric 300 with a fluid 600, such as water. The water 600 is applied to the fabric 300 in, for example, stream or spray form from one or more showers 700, and is directed at both the outer and inner sides 310, 320 of the fabric 300. For instance, according to one embodiment of the present invention, the apparatus 500 includes one or more showers 710 directed at the outer side 310 of the fabric 300 and one or more showers 730 directed at the inner side 320 of the fabric 300. In order to advance the fabric 300 in an appropriate direction to be conditioned by the showers 700, the apparatus 500 further comprises an inlet element 510, such as a roll, wherein the fabric 300 entering the apparatus 500 is advanced at least partially about the roll 510 with the inner side 320 in contact with the roll 510. Initial contact between the fabric 300 and the roll 510 forms an ingoing nip 800 before the fabric 300 advances about the roll 510. As such, in some embodiments of the present invention, the apparatus 500 includes an additional shower 740 comprising, for example, a flooded nip shower, for directing water 600 at the inner side 320 of the fabric 300 at the ingoing nip 800.

Due to the open-weave nature of the fabric 300, however, the water 600 and any residue removed from the fabric 300 will be directed outwardly from the fabric 300 away from the roll 510. Accordingly, the apparatus 500 further includes one or more directional elements 520, such as appropriate vanes, for directing the shed water 600 to a collection device 530. One skilled in the art will appreciate that one or more of the vanes 520 may, in some instances, be perforated or otherwise configured to reduce the velocity of the shed water 600 and/or to reduce misting. The collection device 530 may comprise, for example, a trough for collecting the water, wherein the trough 530 can be configured to drain laterally such as, for example, toward the drive side of the drying section 100. In some embodiments, the trough 530 is also configured so as to be capable of collecting and holding a significant amount of wet portions of the web 400, should the web 400 fail to be separated from the fabric 300 and carried into the fabric-conditioning apparatus 500. As previously discussed, one or more showers 710, 730 directed toward one or both sides 310, 320 of the fabric 300 are disposed downstream of the inlet element 510 for further conditioning the fabric 300. Depending on the orientation of the showers 710, 730 and the advancement direction of the fabric 300 following the inlet element 510, one or more directing devices 540, 550 may be disposed on either or both sides 310, 320 of the fabric 300 so as to direct any excess water 600 shed from the fabric 300 away from the fabric 300. These directing devices 540, 550 may direct the water to respective troughs 530, 560 that are or can be configured to drain laterally with respect to the drying section 100 such as, for example toward the drive side thereof.

Once the water 600 is applied to clean the fabric 300, the fabric 300 must be subsequently dewatered to put the fabric 300 in the appropriate condition for receiving the web 400. However, in some instances, the outer side 310 of a TAD fabric 300 may be or otherwise processed (such as by hot calendering) in order to achieve a desired contact area between the web 400 formed thereon and downstream processes. Sanding of the outer side 310 of the TAD fabric 300 provides for particular contact characteristics between the fabric 300 and the web 400, as well as between the web 400 and downstream processes, and thus may affect, for example, the quality of the web 400, the performance characteristics of the drying section 100, and/or the process parameters of subsequent process steps. For example, the fabric 300 may be sanded to achieve about a 20% contact area between the web 400 and the cylinder of a Yankee dryer, as the web 400 is transferred thereto from the drying fabric 300. As such, the condition of the sanded surface of the fabric 300 may affect some parameters, such as the style or weave pattern imparted to the web 400, the coarseness of the web 400, or the contact area between the web 400 and the cylinder of a Yankee dryer, and thereby affect the properties of the web 400. In such instances of a sanded fabric surface, contact between the outer side 310 of the advancing fabric 300 and stationary objects should preferably be minimized or avoided in order to prevent or minimize wear to the outer side 310. Wear of the outer side 310 of the fabric 300 may undesirably cause, for instance, the contact area between the outer side 310 and the web 400 to increase. Accordingly, embodiments of the present invention further comprise an arcuate member 900 disposed downstream of the showers 710, 730, wherein the arcuate member 900 is configured to have the fabric 300 advanced at least partially thereabout such that the advancing fabric 300 is centrifugally dewatered.

In one embodiment, the arcuate member 900 comprises, for example, a solid roll, a (laterally) segmented roll generally having a smaller diameter than the inlet element 510 or a foil supporting an appropriately-dimensioned arcuate shoe, wherein the segment diameter of the roll or the arc of the shoe are as small as practical in relation to the dimensions or configuration of the fabric 300, while the segment width (lateral) of the segmented roll is of sufficient dimension so as to prevent "whirling," or otherwise to prevent the critical speed (catastrophic instability due to roll sag between supported ends) of the roll from being attained. In either instance, the portion of the arcuate member 900 interacting with the fabric 300 is generally configured to have a relatively small radius or effective diameter. For example, the arcuate member 900 may have an effective diameter on the order of about 100 mm to about 400 mm, though this effective diameter of the arcuate member 900 may vary as necessary and the values presented herein are not intended to be limiting or otherwise restrictive. Further, the angular range of interaction (or wrap angle) of the arcuate member 900 with the fabric 300 that may vary depending on different apparatus and process factors. For example, where an arcuate shoe is implemented, the wrap angle about the shoe may be minimized so as to minimize forces acting on the fabric 300, in instances where the arcuate member 900 contacts the outer side 310 of the fabric 300. However, one skilled in the art will appreciate that the arcuate member 900 for centrifugally dewatering the fabric 300 may have many other configurations and be disposed in many other manners and locations than those described herein, consistent with the scope of the present invention. In one example, a roll having a diameter of about 200 mm and having a relatively large wrap angle, was found to be effective in dewatering the fabric 300, though the wrap angle may vary considerably such as, for example, to as low as about 10 to 15 degrees, though, in some instances, even less of a wrap angle (down to a few degrees) may also be effective. Further, in some instances, the configuration of the arcuate member 900 may be determined as a function of $V^2/R$, where V is the linear operating speed of the papermaking machine and R is the radius of the roll (arcuate member 900). In one particular example, the wrap angle of the fabric 300 is equal to or greater than about 10 degrees about the arcuate member 900.

In one embodiment, the arcuate member 900 is disposed so as to engage the outer side 310 of the fabric 300 as the fabric 300 is advanced. As such, as the fabric 300 is advanced about the arcuate member 900, any water 600 dewatered from the fabric 300 due to the centrifugal force is shed outwardly from the inner side 320 of the fabric 300. In such instances, the collection device 560 for collecting any water 600 shed from the shower 730 directed at the inner side 320 of the fabric 300 may also be extended, such as by appropriate baffles, to collect the water 600 shed due to the centrifugal force. Further, the collection device 560 may also be provided with directional elements (not shown), such as vanes, for directing the shed water 600 to remain in the collection device 500 and to prevent the water 600 from re-wetting the fabric 300.

Further, in some embodiments of the present invention, the apparatus 500 may comprise an intermediate member 920 disposed between the showers 700 and the arcuate element 900. The intermediate element 920 may comprise, for example, a roll arranged to engage the outer side 310 of the advancing fabric 300 such that the fabric 300 wraps at least partially about the intermediate element 920. The roll 920 may be used to, for example, direct the advancing fabric 300 substantially vertically between the inlet element 510 and the intermediate element 920, or to direct the advancing fabric 300 to the arcuate element 900 such that the necessary wrap angle about the arcuate element 900 is attained. Such a configuration is particularly shown in FIG. 4. In some instances, the intermediate element 920 may comprise the arcuate member 900. That is, the intermediate member 920 may be provided instead of the arcuate member 900, as opposed to being provided in addition to the arcuate member 900, wherein the intermediate member 920 is configured to centrifugally dewater the fabric 300. Such a configuration is particularly shown in FIG. 5. However, where the intermediate element 920 is provided in addition to the arcuate member 900, the intermediate element 920 may also function to at least partially dewater the fabric 300 prior to the arcuate element 900. As such, any water 600 shed from the fabric 300 due to the intermediate element 920 will be directed outwardly from the inner side 320 of the fabric 300. In such instances, the collection device 560 may include an additional set of directional elements (not shown), such as vanes, for directing the shed water 600 into the collection device 550 and to prevent the water 600 from re-wetting the fabric 300. On the outer side 310 of the fabric 300, any water 600 extracted from the fabric 300 by the intermediate element 920 may be shed from the roll 920 away from the fabric 300. In such instances, the apparatus 500 may also include an appropriate directional element (not shown), such as a baffle or the underside of the trough 530 for collecting water 600 from the outer surface 310 of the fabric 300, for directing the water 600 shed from the intermediate element 920 back toward the outer side 310 of the fabric 300 or otherwise outwardly of the apparatus 500.

After the conditioned fabric 300 exits the fabric-conditioning apparatus 500, the fabric 300 may be further advanced about subsequent elements, such as rolls 950, 960, in order to, for example, direct the fabric 300 away from the fabric-conditioning apparatus 500 or to provide a mechanism for adjusting (manually or automatically) the tension in the advancing fabric 300. In one embodiment, one of the rolls 950 may comprise an exit element downstream of the arcuate element 900. Where necessary, another dewatering element 970, such as a vacuum box, may be disposed between the arcuate element 900 and the exit element 950, downstream of the fabric-conditioning apparatus 500, so as to provide for any necessary additional dewatering of the fabric 300 before the fabric 300 is advanced back to the point at which the web 400 is received. Where provided, the vacuum box 970 is disposed so as to dewater the fabric 300 from the inner side 320 of the fabric 300, so as to avoid contact with the outer side 310, which may be sanded. The collection device 560 may also be extended about the vacuum box 970 so as to collect any water 600 shed from the fabric 300 or from the vacuum box 970 at this point. In some instances, however, the arcuate element 900 may be configured to provide sufficient dewatering of the fabric 300 such that the vacuum box 970 is not necessary. Where the vacuum box 970 is provided, the previous dewatering of the fabric 300 by the arcuate element 900 may significantly reduce the dewatering capacity of the vacuum box 970 and thus reduce the energy necessary to power the vacuum box 970. For example, in one instance, the arcuate element 900 may provide dewatering of the fabric 300 equivalent to that provide by a single-slotted vacuum box operated at a pressure of about 20 kPa at a fabric speed of about 1200 m/minute. In addition, since the vacuum box 970 is laterally separated from the fabric-conditioning apparatus 500, there is less opportunity for the fabric 300 to be re-wetted before reaching the vacuum box 970, thereby reducing the critically for appropriately sealing the fabric-conditioning apparatus 500 to prevent dispersion of the conditioning fluid 600.

Many modifications and other embodiments of the inventions set forth herein will come to mind to one skilled in the art to which these inventions pertain having the benefit of the teachings presented in the foregoing descriptions and the associated drawings. For example, the apparatus 500 may be housed in a suitable enclosure (not shown) or the collection devices 530, 560 may be configured to be readily accessible so as to facilitate cleaning of the apparatus 500. That is, in some instances, the collection devices 530, 560 may include access ports disposed opposite the drive side of the apparatus 500 which may allow the collection devices 530, 560 to be periodically washed or otherwise cleaned. Such a configuration may also provide sufficient access to allow a high wet strength sheet to be easily handled and removed from the apparatus 500 should operating problems with the drying section 100 (including a Yankee dryer or Yankee section, if provided) should be encountered. Further, the apparatus 500 may include appropriate baffles, such as a baffle (not shown) cooperating with the collection device 560 about the arcuate member 900, to retain the conditioning fluid 600 within the fabric-conditioning apparatus 500. As such any of the collection devices 530, 560, or compartments formed within the apparatus 500 by the baffles, may be connected to a mist-removal system (not shown) so as to minimize escape of the fluid 600 from the apparatus 500. In addition, where necessary, a release shower 990 or other device for providing a release function, along with appropriate collection device(s) (not shown), may be disposed prior to the exit element 950 and directed at the outer side 310 of the fabric 300, for applying an appropriate release agent to the fabric 300 prior to the fabric 300 receiving the web 400. One skilled in the art will also appreciate that, although the configuration of the fabric-conditioning apparatus shown and described herein is implemented in conjunction with a substantially vertical-type conditioning section, the concept may also be implemented in a substantially horizontal-type configuration consistent with the described principles. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

The invention claimed is:

1. An apparatus for conditioning a fabric in a papermaking machine, the fabric having an outer side adapted to engage a paper web and an opposing inner side, said apparatus comprising:

an inlet element configured to engage the inner side of the fabric, the inlet element being further configured to have the fabric wrapped at least partially thereabout so as to form an incoming nip at an upstream engagement therebetween;

a fluid-emitting device configured to wet the fabric with a fluid so as to clean the fabric, the fluid-emitting device further comprising a flooded nip shower disposed upstream of the inlet element and configured to direct the fluid into the incoming nip;

an arcuate member disposed downstream of the inlet element and configured to engage the outer side of the fabric, the arcuate member being further configured to have the fabric wrapped at least partially thereabout such that the fabric advanced thereabout is centrifugally dewatered; and a vacuum device disposed downstream of the arcuate member and laterally spaced apart from the inlet element and the arcuate member so as to reduce re-wetting of the fabric, the vacuum device being configured to engage the inner side of the fabric so as to dewater the fabric with suction following centrifugal dewatering thereof by the arcuate member.

2. An apparatus according to claim 1 further comprising at least one of:

a collection device disposed downstream of the incoming nip and about the outer surface of the fabric so as to collect fluid emitted through the outer side of the fabric as the fabric is advanced about the inlet element;

at least one of an inner shower configured to direct the fluid at the inner side of the fabric and an outer shower configured to direct the fluid at the outer side of the fabric, the at least one of an inner shower and an outer shower being disposed between the inlet element and the arcuate member; and an outer shower configured to direct the fluid at the outer side of the fabric and a collection device disposed upstream of the arcuate member.

3. An apparatus according to claim 1 further comprising;

an intermediate element disposed between the inlet element and the arcuate member and configured to engage the outer side of the fabric, the intermediate element being further configured to have the fabric wrapped at least partially thereabout; and a baffle element disposed generally opposite the intermediate element from the fabric, the baffle element being configured to direct fluid shed by the intermediate element toward the fabric upstream of the arcuate element.

4. An apparatus according to claim 1 further comprising a collection device disposed about the arcuate member and configured to collect the fluid centrifugally dewatered from the fabric about the arcuate member.

5. An apparatus according to claim 1 wherein the arcuate member is selected from the group consisting of a segmented roll and a foil having an arcuate shoe, and wherein the arcuate member is further configured to have an effective diameter of between about 100 mm and about 400 mm.

6. An apparatus according to claim 1 wherein the arcuate member is further configured to have the fabric wrapped thereabout at a wrap angle of at least about ten degrees.

7. A drying section for a papermaking machine, comprising:

a drying device configured to dry a paper web;

a fabric having an outer side adapted to engage the web and an opposing inner side, the fabric being further configured to receive the web upstream of the drying device and to transport the web to the drying device so as to allow the drying device to interact with and dry the web, the web then being separated from the fabric downstream of the drying device; and an apparatus configured to condition the fabric before the web is received by the fabric and after the web is separated from the fabric, the apparatus comprising:

an inlet element configured to engage the inner side of the fabric, the inlet element being further configured to have the fabric wrapped at least partially thereabout so as to form an incoming nip at an upstream engagement therebetween;

a fluid-emitting device configured to wet the fabric with a fluid so as to clean the fabric, the fluid-emitting device further comprising a flooded nip shower disposed upstream of the inlet element and configured to direct the fluid into the incoming nip;

an arcuate member disposed downstream of the inlet element and configured to engage the outer side of the fabric, the arcuate member being further configured to have the fabric wrapped at least partially thereabout such that the fabric advanced thereabout is centrifugally dewatered; and a vacuum device disposed downstream of the arcuate member and laterally spaced apart from the inlet element and the arcuate member so as to reduce re-wetting of the fabric, the vacuum device being configured to engage the inner side of the fabric so as to dewater the fabric with suction following centrifugal dewatering thereof by the arcuate member.

8. A drying section according to claim 7 wherein the fabric further comprises at least one of a through-air drying fabric, a coarse drying fabric, an embossing fabric, and a molding fabric.

9. A drying section according to claim 7 further comprising at least one of:

a collection device disposed downstream of the incoming nip and about the outer surface of the fabric so as to collect fluid emitted through the outer side of the fabric as the fabric is advanced about the inlet element;

at least one of an inner shower configured to direct the fluid at the inner side of the fabric and an outer shower configured to direct the fluid at the outer side of the fabric, the at least one of an inner shower and an outer shower being disposed between the inlet element and the arcuate member; and an outer shower configured to direct the fluid at the outer side of the fabric and a collection device disposed upstream of the arcuate member.

10. A drying section according to claim 7 further comprising;

an intermediate element disposed between the inlet element and the arcuate member and configured to engage the outer side of the fabric, the intermediate element being further configured to have the fabric wrapped at least partially thereabout and a baffle element disposed generally opposite the intermediate element from the fabric, the baffle element being configured to direct fluid shed by the intermediate element toward the fabric upstream of the arcuate element.

11. A drying section according to claim 7 further comprising a collection device disposed about the arcuate member and configured to collect the fluid centrifugally dewatered from the fabric about the arcuate member.

12. A drying section according to claim 7 wherein the arcuate member is selected from the group consisting of a segmented roll and a foil having an arcuate shoe, and wherein the arcuate member is further configured to have an effective diameter of between about 100 mm and about 400 mm.

13. A drying section according to claim 7 wherein the arcuate member is further configured to have the fabric wrapped thereabout at a wrap angle of at least about ten degrees.

14. A drying section according to claim 7 wherein the apparatus is disposed between respective exhaust systems of two adjacent drying devices so as to provide a compact drying section.

15. A drying section according to claim 14 wherein each of the two adjacent drying devices further comprises a hood, the two hoods cooperating to define a gutter therebetween, with the gutter being configured to receive the apparatus therein.

16. A method of conditioning a fabric in a papermaking machine, the fabric having an outer side adapted to engage the web and an opposing inner side, said method comprising:

advancing the fabric at least partially about an inlet element disposed upstream of the arcuate member and configured to engage the inner side of the fabric, the fabric and the inlet element thereby forming an incoming nip at the upstream engagement therebetween;

wetting the fabric, with a fluid, the fluid being emitted from a fluid-emitting device comprising a flooded nip shower disposed upstream of the inlet element, by directing the fluid into the incoming nip so as to clean the fabric;

advancing the fabric at least partially about an arcuate member disposed downstream of the inlet element, the arcuate member being configured to engage the outer side of the fabric, so as to centrifugally dewater the fabric; and dewatering the fabric with suction provided by a vacuum device, the vacuum device being disposed downstream of the arcuate member to engage the inner side of the fabric and being laterally spaced apart from the inlet element and the arcuate member so as to reduce re-wetting of the fabric, following centrifugal dewatering thereof by the arcuate member.

17. A method according to claim 16 further comprising at least one of:

collecting fluid emitted through the outer side of the fabric as the fabric is advanced about the inlet element with a collection device disposed downstream of the incoming nip and about the outer surface of the fabric;

wetting the fabric by directing the fluid at the fabric between the inlet element and the arcuate member with at least one of an inner shower configured to direct the fluid at the inner side of the fabric and an outer shower configured to direct the fluid at the outer side of the fabric; and wetting the fabric by directing the fluid at the outer side of the fabric and collecting fluid from the outer shower, shed by the fabric, with a collection device disposed upstream of the arcuate member.

18. A method according to claim 16 further comprising;

advancing the fabric at least partially about an intermediate element disposed between the inlet element and the arcuate member and configured to engage the outer side of the fabric and directing fluid shed by the intermediate element toward the fabric upstream of the arcuate element with a baffle element disposed generally opposite the intermediate element from the fabric.

19. A method according to claim 16 further comprising collecting the fluid centrifugally dewatered from the fabric about the arcuate member with a collection device disposed about the arcuate member.

20. A method according to claim 16 wherein advancing the fabric about an arcuate member further comprises at least one of:

advancing the fabric about an arcuate member selected from the group consisting of a segmented roll and a foil having an arcuate shoe; and advancing the fabric about an arcuate member having an effective diameter of between about 100 mm and about 400 mm.

21. A method according to claim 16 wherein advancing the fabric about an arcuate member further comprises advancing the fabric about an arcuate member over a wrap angle of at least about ten degrees.

* * * * *